United States Patent [19]

Nelson

[11] 4,403,470

[45] Sep. 13, 1983

[54] PROCESS FOR MAKING COMPOSITE YARN OF CONTINUOUS FILAMENTS AND STAPLE FIBERS

[75] Inventor: Thomas L. Nelson, Georgetown, Del.

[73] Assignee: E. I. Du Pont de Nemours and Company, Wilmington, Del.

[21] Appl. No.: 335,643

[22] Filed: Dec. 30, 1981

[51] Int. Cl.[3] ..... D02G 3/38; D02G 3/42

[52] U.S. Cl. ..... 57/5

[58] Field of Search ..... 57/3, 5, 6, 12, 24

[56] References Cited

U.S. PATENT DOCUMENTS

| | | | |
|---|---|---|---|
| 3,043,087 | 7/1962 | Breen et al. | 57/5 |
| 3,043,088 | 7/1962 | Breen | 57/5 X |
| 3,439,491 | 4/1969 | Scruggs | 57/5 |
| 3,845,611 | 11/1974 | Senturk | 57/5 |
| 4,359,856 | 11/1982 | Bobkowicz | 57/5 |

*Primary Examiner*—Donald Watkins

[57] ABSTRACT

An improved process for making a composite yarn of staple fibers commingled with bulked continuous filaments comprises passing a yarn of crimped continuous filaments while under tension between nip rolls which advance the yarn into a splaying zone where the filaments are permitted to contract and splay of their own accord into an open three-dimensional filament network into which airborne staple fibers are projected for commingling with the filaments after which the open network is collapsed and the composite yarn is withdrawn at a slightly lower speed than that at which the nip rolls advance the feed yarn.

4 Claims, 1 Drawing Figure

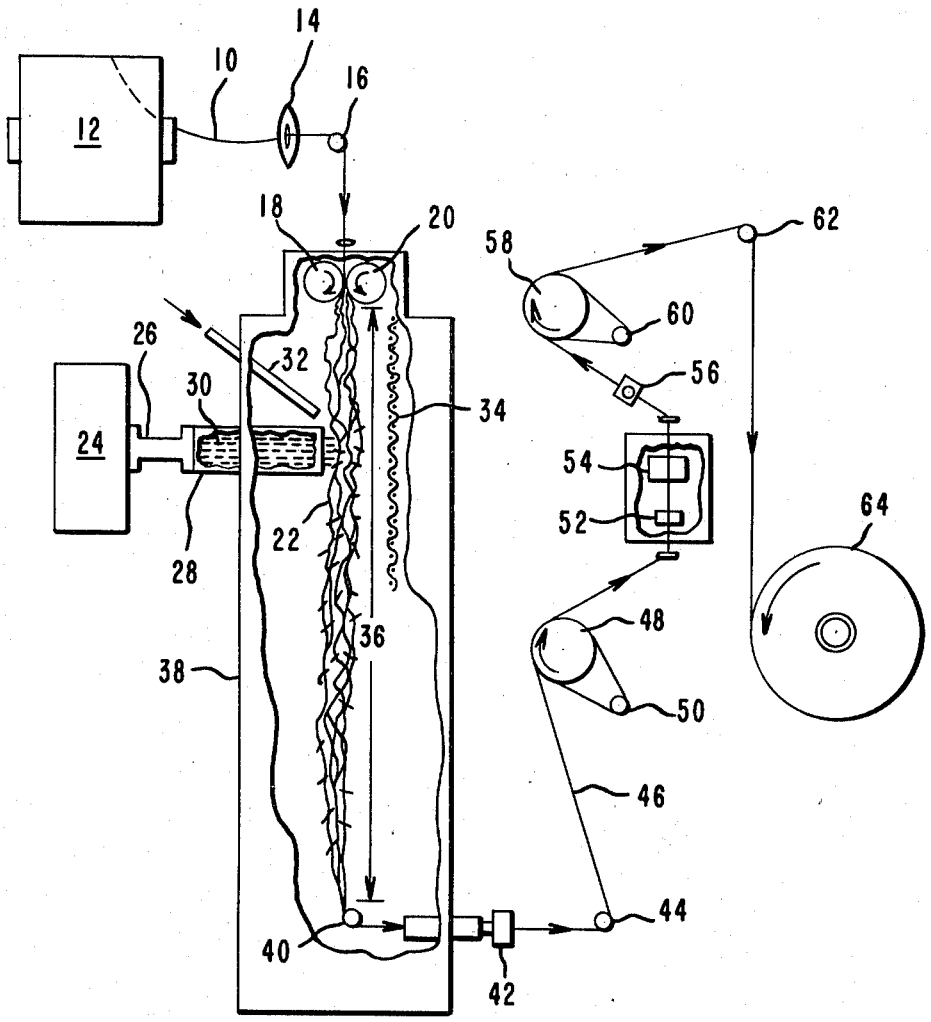
14
10
16
12
18
20
58
62
60
26
32
56
30
34
24
54
52
64
22
28
48
36
38
50
46
44
40
42

PROCESS FOR MAKING COMPOSITE YARN OF CONTINUOUS FILAMENTS AND STAPLE FIBERS

DESCRIPTION

1. Technical Field

This invention concerns a process for making a continuous filament yarn having staple fibers entangled within it. More partaicularly, it concerns a process wherein a moving yarn of continuous filaments is splayed open in a zone where staple fibers are projected into the opened yarn and become entrapped therein as the filaments are collapsed back into a yarn structure.

2. Background Art

Yarns of continuous filaments can be made to have aesthetics more like those of staple yarns, which have protruding fiber ends along the yarn surface, by blending and entangling staple fibers among the continuous filaments along the yarn. In addition to greater bulk and more staple-like character a variety of decorative effects can be achieved through selection of filaments and fibers having particular characteristics and made of different materials. U.S. Pat. No. 3,259,939 (Skalko et al.) discloses a process for making such yarns wherein a freshly spun strand of continuous filaments is directed through the nip region of a pair of pull rolls to advance the strand to a zone where means is provided to effect a separation of the filaments of the strand so that the filaments are temporarily dispersed in an open pattern or open network. To achieve this the strand is impinged upon a deflecting surface and projected therefrom in a different direction. The impingement of the strand against the deflector disperses or separates the filaments into an open pattern and means is provided for feeding staple fibers into the region of the open pattern to commingle or blend the fibers with the continuous filaments. The combined filaments and staple fibers are then advanced through a compactor which compacts the materials into a composite filamentary structure which is wound to form a package. The compactor may be provided with an angularly disposed tube adapted to be connected with a source of compressed air to direct a jet of air into the compactor to assist in integrating the staple fibers into the strand as the filament are progressively converged during movement through the compactor. In such a process, introduction and commingling of the staple fibers into the opened filament network is hindered by the two-dimensional splaying action of the deflector.

An object of this invention is an improved process for the blending and commingling of staple fibers with a continuous filament yarn, and particularly with a bulked continuous filament yarn.

BRIEF DESCRIPTION OF THE DRAWING

The accompanying FIGURE is a schematic representation of an apparatus in use according to a preferred embodiment of a process of this invention.

DISCLOSURE OF THE INVENTION

This invention provides an improved process for making a composite yarn of staple fibers commingled with continuous filaments, which yarn possesses individual characteristics of the fibers and the filaments comprising it, including the steps of passing a feed yarn of continuous filaments, while under tension and substantially free of twist and filament entanglement, through a nip region formed by a pair of counter rotating rolls which advance the yarn to a splaying zone in air wherein the filaments are splayed into an open network and airborne staple fibers are projected from a source angularly into the open network to combine and commingle with the continuous filaments after which the open network is collapsed into said composite yarn wherein the improvement comprises creating said open network of continuous filaments by passing through said nip region as the feed yarn and yarn of crimped continuous filaments of a synthetic organic polymer which individually contract from crimp retractive forces substantially immediately upon passing through said nip region and splay of their own accord into an open three-dimensional filament network which cntinues to travel in a substantially linear direction at a slightly reduced speed and projecting said airborne staple fibers into said three-dimensional network.

The process of this invention is particularly useful for making bulked continuous filament carpet and upholstery yarns having special decorative effects provided by the commingled staple fibers, such as to provide different colorability either continuously or intermittently along the yarn. Such feed yarns are already bulked of themselves therefore need not rely upon the staple fibers to provide bulk per se.

Carpet and upholstery yarn commonly have a denier of at least about 500 and contain continuous filaments having a denier per filament of at least about 5.

Increasing nip roll speeds increase the stability of formation and of the shape, size and position of the opened filament network in the splaying zone. For a typical bulked continuous filament carpet yarn having a denier of 1225 and containing 80 filaments it is found that yarn speed in the 500–600 ypm (457–549 mpm) range will initiate a substantial splayed region in the form of a quite large cylinder-shaped open network but which tends to be somewhat unstable. This splayed region becomes quite stable although with some reduction in cylindrical volume at speeds above 800 ypm (732 mpm). The yarn speed as advanced by the nip region necessary to maintain the desired high degree of splay zone will of course vary to some extent with the denier of the yarn and filaments involved but can be easily determined for each case.

To achieve adequate volume and stability of the splayed region requires that the continuous filament yarn be bulked and substantially free from yarn twist or filament entanglement. The yarn preferably should have sufficient freedom from entanglement to have a cohesion factor of less than 5 as defined in U.S. Pat. No. 2,985,995. Entanglement may be removed from bulked continous filament yarns as known in the art by passing it through a series of parallel metal pins in tandem under tension as disclosed for example in U.S. Pat. No. 4,059,873, if needed. The splaying efficiency of the bulked continuous filament yarn is not significantly affected by the denier per filament of filaments within the common carpet denier range of 10 to 35 dpf, and particularly 15 to 19 dpf, and is not highly sensitive to the presence of normal yarn spin finishes; however, to the extent that the splaying action is brought about by electrostatic forces the efficiency can be reduced somewhat by the presence of antistatic filaments in the feed yarn.

In the splaying zone, the filaments open to form a network of substantially rectangular or cylindrical cross-sectional shape having a cross-sectional area 1,000 times or more than the area of the yarn itself, thus providing ample space and opportunity for the staple fibers to penetrate and commingle with the continuous filaments.

The splaying action of the filaments in addition to being facilitated by crimp retractive forces in filaments of the bulked feed yarn and the retarding action of ambient air is also believed to be facilitated by electrostatic forces causing filaments to repel one another in the yarn. Such electrostatic forces can be increased by proper selection of surfaces with which the yarn comes in contact prior to the splaying zone. For instance, a nip region formed by a metal, e.g., steel, surfaced driver roll and a coacting elastomeric surfaced idler roll facilitates such action. It is known for instance that the movement of yarn over rolls at high speed tends to generate static electricity within the yarn.

Water or other liquid applied to the splayed filaments as a mist or aerosol can be used to neutralize such electrostatic forces and permit the splayed filaments to come together more readily and rapidly as they leave the splaying zone. Such an aerosol can be supplied to the open filament network at or below the region at which the staple fibers are introduced to facilitate commingling between the filaments and fibers and also collapsing of the network into the composite yarn. Also the capillary action of the liquid on the surfaces of the filaments and fibers tends to bind them together more firmly and facilitates subsequent processing and handling.

The larger more open three-dimensional network of crimped continuous filaments more readily permits the staple fibers to penetrate among and through the continuous filament bundle as compared to the substantially two-dimensional network achieved by the splaying of straight filaments impacting with a flat surface as known from U.S. Pat. No. 3,259,939 for example.

Other means known in the art can be used to increase the electrostatic forces within the yarn to further enhance splaying. It follows also that the efficiency of commingling can be increased by applying an opposite electrostatic charge to the staple fibers by well known tachniques causing them to be attracted to the continuous filaments; but in such a process any liquid applied to neutralize such forces should be directed on the filaments below the region at which the staple fibers first meet with the continuous filaments.

As alternatives to being advanced downwardly by the nip rolls as shown in the FIGURE, the continuous filaments can be advanced laterally or upwardly to the splaying zone as well.

The continuous filaments may be of any fiber-forming synthetic organic polymeric material. The low density of such materials, with respect to inorganic fiber-forming materials such as glass, facilitates splaying of the filaments as they encounter air in the splaying zone. The staple fibers may be crimped or uncrimped, but preferably crimped, and of different color or colorability versus the continuous filaments. Suitable staple fibers include natural fibers such as cotton or wool or synthetic fibers having properties which provide any desirable aesthetic to the resulting product. The staple fibers can be selected according to length, denier per fiber, cross-sectional shape, conductivity or other physical or chemical property to give a broad range of composite properties. Whereas yarns with free fiber ends as provided by staple fibers can burn more readily than a smooth filament yarn, this property can be offset if desired by using staple fibers having fire-retarding properties whereupon the overall burning rate of the composite yarn may be decreased with respect to the unmodified feed yarn.

A typical splaying zone is from about 2 to 6 inches (5.8 to 15.2 cm) in diameter and approximately 20 inches (51 cm) long. The splay zone generally persists in the zone between the nip rolls and a collecting or compacting device such as a guide or receiving jet device through which the composite yarn is forwarded at a speed slightly slower than that at which the feed yarn is advanced by the nip rolls.

The nip rolls can be comprised of commonly used materials, such as a steel drive roll and an elastomer-covered idler roll. Conventional staple fiber dispersing and forwarding systems can be employed as a suitable source, such as a modified beater assembly from an Elitex (Czechoslovakia) BD-200 open-end spinning head. In operation, a staple sliver is forwarded via intergral pinch rolls to a rotating comber where the sliver is combed and the individual fibers are discharged through a narrow opening in the enclosure wall. At this point, the fibers may be aspirated into an aspirating internal coanda jet to greatly increase fiber velocity from the jet into the splaying zone. Suitable fiber dispersing and forwarding systems are also disclosed in U.S. Pat. No. 3,259,939, for example as disclosed with respect to FIG. 1 therein.

If the volume of air and staple fibers being projected into the splaying zone is sufficiently large to cause the filament network to be substantially displaced from an otherwise sustantially linear yarn path, a grid or other suitable backing which allows the air carrying the fibers to pass through can be positioned on the opposite side of the splaying zone from the source of the fibers to prevent excessive displacement.

With reference to the FIGURE, which is a schematic representation of a preferred embodiment of this invention, the bulked continuous filament yarn 10 is pulled from package 12 and travels through balloon guide 14 over idler roll 16 and between steel driver roll 18 and elastomer covered idler roll 20 which together forward the yarn from the nipping zone between them downwardly into enclosure 38 wherein the filaments of yarn 10 splay apart to form an open network of filaments 22 in splaying zone 36. Staple fibers from a dispersed fiber supply 24 are supplied through a coanda aspiration jet 26 which projects them through nozzle 28 to intersect with the open network of filaments 22. Water or other liquid in aerosol form is supplied through conduit 32 into splaying zone 36 at a location near that where the staple fibers 30 intersect filament network 22. An optional open wire grid 34 is positioned on the opposite side of splaying zone 36 from nozzle 28 to prevent the network 22 from bending excessively from its substantially linear, vertically downward path. Staple fibers 30 are deposited within and commingled with the filament network 22 and are trapped therein as the yarn leaves splaying zone 36 and becomes collapsed as it passes around idler roll 40 and enters a coanda stripper jet 42 which removes overly loose fibers from the composite yarn 46.

Enclosure 38 surrounds the splaying zone and staple supply nozzle and can be furnished with a suitable system for exhausting air in a controlled manner and for recovering and recycling staple fibers which are not taken up by the continuous filament yarn. Coanda jet 42 operates counter-current to the yarn direction so that staple fibers which have not been firmly entrapped within the yarn are directed back into the enclosure 38.

Driven roll 48 and its associated idler roll 50 operate at a slightly lower surface speed than nipping rolls 18 and 20 to pull the yarn from the splaying zone 36 and around idler roll 44 and to forward it to a water applicator 52 and entangling air jet 54 which consolidates the fibers and filaments further into a more cohesive yarn.

Let-down roll 58 and its associated idler roll 60 operate at a surface speed slightly slower than take-up roll 48 to maintain the yarn under suitable tension for entangling jet 54 and past doffing cutter 56. The yarn then passes around idler roll 62 and is wound up and yarn package 64.

More than one feed yarn may be used. Where multiple ends are employed they may be of the same or different color or dyeability with respect to each other, or to the staple fibers.

Instead of using stripper jet 42 to remove loosely bound staple fibers, the composite yarn 46 may travel from enclosure 38 to entangling jet 54 through a tube which would prevent escape of loose staple and entangling jet 54 can be enclosed in a suitable shroud to collect staple fibers escaping from the yarn during the entangling operation.

The dispersed staple fiber supply 24 can be similar to feed systems used for open-end spinning of staple fibers but larger nip roll and comber rolls can be used and which run at a much higher surface speed.

For the following examples the comber roll used in the fiber supply is 36 inches (914.4 mm) in circumference and 3 inches (76.2 mm) in width and runs at a speed of up to 15,000 rpm. Aspirator jet 26 which forwards the fibers into nozzle 28 is an internal Coanda type jet made by Union Fluonetics, model AGV-10 operated with an air pressure of 20–40 psig (138–276 kPa). Also for the examples entangling jet 54 has a cylindrical yarn passage 1.0 inch (25.4 mm) long and 0.125 inch (3.15 mm) diameter. A single air conduit of 0.093 inch (2.36 mm) diameter intersects the yarn passage perpendicularly at its center.

EXAMPLE 1

A 1225 denier (1360 decitex) 80 filament yarn of poly(hexamethylene adipamide) having filaments of a rounded quadrilateral cross section with four parallel continuous voids (as represented in FIG. 3 of U.S. Pat. No. 3,745,061) which has been hot fluid jet bulked in accordance with Windley U.S. Pat. No. 3,971,202 along with three antistatic sheath-core filaments having a total denier of 20, and of the type disclosed in U.S. Pat. No. 3,803,453 (Hull), is fed from a feed yarn package through a process as represented by the accompanying FIGURE. Filament entanglement in the yarn has been substantially reduced by tensioning of the yarn with the aid of tandem parallel pins as known in the art such that the coherency factor of the yarn is less than 5. The speed of the nipping rolls 18 and 20 forwards the yarn at 2100 ypm (1919 mpm) with the 2 rolls being pressed together with a force of 10 lbs. (44.5 N) to grip the yarn. Into the dispersing fiber supply is fed three silver ends of nylon staple. The staple is of 3.0 denier per fiber (3.3 decitex) and 1.5 inch (3.8 cm) long which has been stuffer box crimped. The silver ends are each 50 grain (3.29 g) weight. The three slivers have each been dyed respectively orange, green and blue and are fed together to the comber roll which removes fibers from the silvers and delivers them nonuniformly to the forwarding jet which projects them through the nozzle and into the splaying zone of the yarn. Further details of the staple delivery system are given in Table 1. Two aerosol mist applicators 32 supply water (aerosol) at a rate of about 0.5–1.0 gallon/hr. (1.9–3.8 liters/hr.). The composite yarn is then collapsed and passes through the remainder of the process substantially as described with respect to the FIGURE.

The nonuniform staple fiber delivery results in a composite yarn in which clumps of staple fibers of various sizes and of the various colors are distributed irregularly along the length of the yarn. Portions of the staple fibers are entangled among the continuous filaments and other portions protrude from the yarn surface at varying distances along it. Other individual staple fibers or smaller groups of fibers are scattered irregularly along and throughout the remainder of the yarn and can be seen as loop and free ends protruding from the yarn.

A tufted carpet made from the yarn shows flecks of orange, green and blue colors against a background of the bulked continuous filament yarn which is dyed a different color. The texture of the carpet simulates a Berber wool product.

EXAMPLE 2

Another bulked continuous filament nylon yarn of the same type as in Example 2 but without the antistatic filaments is fed through a process as in Example 1 except that the surface speed of the nip rolls 18, 20 is 1,000 ypm (914 mpm). A single undyed 50 grain (3.29 g) silver similar to Example 1 is fed through the staple supply system under operating conditions as shown in Table 1 to give a more uniform continuous distribution of individual fibers which are substantially free of large clumps. In a typical section of the resulting composite yarn individual staple fibers are distributed relatively evenly along the length of the yarn. Some fibers are interwoven completely with the filament bundle and are not visible from the surface. Others are interwoven but have one or both ends protruding from the composite yarn bundle. The majority of the commingled fibers have one or both ends interwoven in the bundle and one or more portions protruding varying distances from the bundle as irregular arch-like loops. A tufted carpet made from this yarn and dyed with an acid dye as a natural wool-like appearance and an even pile character. The staple fibers dyed to a lighter shade than the continuous filaments, thus contributing to this appearance.

Composite yarns intermediate in character between those of Examples 1 and 2 can be made by changing the staple delivery condition. The low speed of the comber roll favors a more uniform staple fiber delivery; while a higher speed favors irregular delivery.

TABLE I

| | EX. 1 | EX. 2 |
|---|---|---|
| CONTINUOUS FILAMENT YARN | | |
| Throughput at Feed Rolls (gms/min) | 265 | 126 |
| STAPLE DELIVERY SYSTEM | | |
| Speed-Comber Roll (ypm) | 2750 | 1570 |
| (mpm) | 2514 | 1435 |
| Staple Throughput (gms/min) | 8.2 | 1.0 |
| Air Pressure to Forwarding Jet (p.s.i.g.) | 10 | 2 |
| (kPa) | 69.9 | 14.0 |
| THROUGHPUT RATIO | | |

TABLE I-continued

| | EX. 1 | EX. 2 |
|---|---|---|
| STAPLE/CONTINUOUS FILAMENT | 0.031 | 0.008 |

I claim:

1. In a process for making a composite yarn of staple fibers commingled with continuous filaments including the steps of passing a feed yarn of continuous filaments which is under tension and substantially free of twist and filament entanglement through a nip formed by a pair of counter rotating rolls which advance the yarn to a splaying zone in air wherein the filaments are splayed into an open network and airborne staple fibers are projected from a source angularly into the open network to combine and commingle with the continuous filaments after which the open network is collapsed into said composite yarn, the improvement which comprises creating said open network of continuous filaments by passing through said nip region as the feed yarn a yarn of crimped continuous filaments of a synthetic organic polymer which filaments individually contract from crimp retractive forces substantially immediately upon passing through said nip region and splay of their own accord into an open three-dimensional filament network which continues to travel in a substantially linear direction at a slightly reduced speed and projecting said staple fibers into said three-dimensional network.

2. A process of claim 1 in which the feed yarn has yarn and filament deniers appropriate for use as a carpet yarn and the formation of the three-dimensional network is stabilized by passing the yarn through the nip region at a speed of at least 800 ypm.

3. A process of claim 1 in which said nip region is formed by a steel driver roll and an elastomeric-surfaced idler roll which form an electrostatic charge on the filaments as they pass through the nip region.

4. A process of claim 1 in which a liquid aerosol is supplied to the three-dimensional filament network at or below the region at which the staple fibers are introduced to dissipate electrostatic charges and to facilitate commingling between the filaments and fibers and collapsing of the network into the composite yarn.

* * * * *